US006389808B1

(12) United States Patent
Sakai

(10) Patent No.: US 6,389,808 B1
(45) Date of Patent: May 21, 2002

(54) CONTROL UNIT FOR CONSTRUCTION MACHINE

(76) Inventor: Noriyuki Sakai, 731-1, Naganumaharacho, Inage-ku, Chiba-shi, Chiba-ken (JP)

( * ) Notice: Subject to any disclaimer, the term of this patent is extended or adjusted under 35 U.S.C. 154(b) by 0 days.

(21) Appl. No.: 09/634,968

(22) Filed: Aug. 9, 2000

(30) Foreign Application Priority Data

Oct. 19, 1999 (JP) ..... 11-297328

(51) Int. Cl.[7] ..... F16D 31/02
(52) U.S. Cl. ..... 60/422; 60/329; 60/452
(58) Field of Search ..... 60/329, 431, 445, 60/452, 422; 417/32

(56) References Cited

U.S. PATENT DOCUMENTS 5,249,421 A * 10/1993 Lunzman ..... 60/422
5,251,440 A * 10/1993 Bong-dong et al. ..... 60/445
5,758,499 A * 6/1998 Sugiyama et al. ..... 60/452

* cited by examiner

*Primary Examiner*—Edward K. Look
*Assistant Examiner*—Thomas E. Lazo
(74) *Attorney, Agent, or Firm*—Fattibene & Fattibene; Paul A. Fattibene; Arthur T. Fattibene

(57) ABSTRACT

In a hydraulic shovel which operates in a high-speed operation mode and a low-speed operation mode, an object of the present invention is to satisfy both low fuel consumption operation speed. To achieve the object, there is provided a control unit for a construction machine comprising a first hydraulic pump 12 and a second hydraulic pump 13 driven by an engine 19, in which control valves 1 to 8 for various actuators are connected to oil paths of the hydraulic pumps 12 and 13, the control valves 1 to 8 are operated by a remote-control valve 11, an operation mode of the construction machine can be switched to either one of a low-speed operation mode and a high-speed operation mode, wherein when the construction machine is operated in the low-speed operation mode and when a pressure sensor 16 detects an operating speed of an operating lever of the remote-control valve 11 and the detection value exceeded a predetermined value, the operation mode is automatically switched from the low-speed operation mode to the high-speed operation mode by a command signal from a controller 21.

6 Claims, 7 Drawing Sheets

Diagram showing performance of pump

Diagram showing performance of engine

CONTROL UNIT FOR CONSTRUCTION MACHINE

BACKGROUND OF THE INVENTION

1. Field of the Invention

The present invention relates to a control unit for a construction machine, and more particularly, to a control unit for a construction machine capable of operating while switching operation mode between a low-speed operation mode and a high-speed operation mode.

2. Description of Relevant Art

A conventional control unit for a construction machine of this kind will be explained with reference to FIGS. 2, 3 and 7. FIG. 2 is a diagram showing performance of a pump, FIG. 3 is a diagram showing performance of an engine. These drawings are used also for explaining an embodiment of the present invention. FIG. 7 is a diagram of a control circuit of mainly a hydraulic shovel.

In FIG. 7, a reference number 12 represents a first hydraulic pump 12, and a reference number 13 represents a second hydraulic pump. Control valves 1 to 8 for various actuators such as a boom, an arm a bucket and a cylinder are connected to oil paths of the first and second hydraulic pumps 12 and 13. The first and second hydraulic pumps 12 and 13 are driven by an engine 19. A fuel-injection amount and a fuel-injection timing of the engine 19 are adjusted by a control actuator 20 of an engine governor. The control actuator 20 of the engine governor is operated by a command signal from a controller 21. Discharged oil from the first and second hydraulic pumps 12 and 13 is controlled by an actuator 15 comprising a solenoid proportional valve. The actuator 15 is operated by a command signal from the controller 21.

The construction machine is constructed such that it can be operated while switching operation mode between a low-speed operation mode and a high-speed operation mode. The switching operation is carried out by manually operating, by an operator, an operation-mode selecting switch 26 connected to the controller 21. In the drawing, a reference number 14 represents a pilot pump, and a reference number 22 represents a battery.

As shown in FIGS. 2 and 3, the operation mode comprises A mode having excellent speed and power (which will be referred to as "high-speed operation mode" hereinafter), and B mode suitable for low fuel-consumption and fine operation (which will be referred to as "low-speed operation mode" hereinafter). The operator manually operate the operation-mode selecting switch 26 to select desired either one of the operation modes. The controller 21 recognizes ON and OFF of the operation-mode selecting switch 26. When the operation-mode selecting switch 26 is ON for example, the controller 21 judges that the high-speed operation mode was selected, the controller 21 sends a command signal to the actuator 20 of the engine governor which controls the engine 19, thereby switching the engine 19 to the high-speed operation mode. At the same time, the controller 21 also sends a command signal to the actuator 15 which controls discharging oil of the first and second hydraulic pumps 12 and 13, and the discharge oil of the first and second hydraulic pumps 12 and 13 is switched, by the actuator 15, to high output state which is suitable for the high-speed operation mode.

When the operation-mode selecting switch 26 was switched to OFF manually by the operator, the controller 21 sends a command signal to the actuators 20 and 15 so that the engine 19 as well as the first and second hydraulic pumps 12 and 13 are switched to the low-speed operation mode, and the operation in the low-speed operation mode is carried out.

When the operation-mode selecting switch is switched to the high-speed operation mode by the operator's manual operation, since the high-speed operation mode is excellent in speed and power, the mode is suitable for operation requiring high speed or great load. However, during a series of operation in the high-speed operation mode, even when the construction machine is operating with low load or under fine control, such an operation is carried out while keeping the high engine output and thus, fuel is consumed wastefully. In order to avoid such a wasteful fuel consumption, the operation-mode selecting switch must be switched to the low-speed operation mode by the manual operation whenever it is required. Such a switching operation is troublesome. Generally, the operator does not carry out the switching operation, and fuel is consumed wasteful as described above.

When the operator switches the operation-mode selecting switch 26 to carry out operation in the low-speed operation mode, the low-speed operation mode is excellent for fine operation by the operator and reduction in fuel, but when it is desired to operate the machine faster during the series of operation in the low-speed operation mode, or when greater power is required, speed and power of this mode are insufficient, and this mode can not satisfy the speed and power that the operator requires. It is extremely troublesome to manually switch the operation-mode selecting switch to avoid this each time.

SUMMARY OF THE INVENTION

In the construction machine which is operated while selecting either one of the high-speed operation mode and the low-speed operation mode, there is a technical problem to be solved for satisfying both the low fuel consumption of the engine and appropriate operation speed without troublesome switching operation of the operation-mode selecting switch by manual operation of the operator as in the convention technique, and it is an object of the present invention to solve the problem.

The present invention has been proposed to achieve the above object, and the invention provides a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein when the construction machine is operated in the low-speed operation mode and when a pressure sensor detects an operating speed of an operating lever of the remote-control valve and the detection value exceeded a predetermined value, the operation mode is automatically switched from the low-speed operation mode to the high-speed operation mode by a command signal from a controller: a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein when the construction machine is operated in the low-speed operation mode and when the sum of detection values detected by pressure sensors respectively provided for detecting pressures of the first and second hydraulic pumps exceeded a predetermined value for a predetermined time or longer, the operation mode is automatically switched from the low-speed operation mode to the high-speed operation mode by a command signal from a controller: a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein when the construction machine is operated in the high-speed operation mode and when a pressure sensor detects a hydraulic pressure of the hydraulic pump connected to a boom and the detection value becomes equal to or lower than a predetermined value, the operation mode is automatically switched from the high-speed operation mode to the low-speed operation mode by a command signal from a controller: a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein a radiator water-temperature sensor for detecting a water temperature of a radiator of the engine is provided, and when a detection value of the radiator water-temperature sensor reached a value of warming-up of the engine, the controller sends a command signal which enables the construction machine to operate in the low-speed operation mode or the high-speed operation mode: a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein a hydraulic oil sensor for detecting a temperature of hydraulic oil in the first and second hydraulic pumps is provided, and when a detection value of the hydraulic oil sensor reached a value of warming-up of a hydraulic system, the controller sends a command signal which enables the construction machine to operate in the low-speed operation mode or the high-speed operation mode: and a control unit for a construction machine comprising a first hydraulic pump and a second hydraulic pump driven by an engine, in which control valves for various actuators are connected to oil paths of the hydraulic pumps, the control valves are operated by a remote-control valve, an operation mode of the construction machine can be switched to either one of a low-speed operation mode and a high-speed operation mode, wherein pressure sensors are provided in pilot oil paths of the first and second hydraulic pumps, and when the pilot oil paths were cut off by switching operation of a running control valve during running of the construction machine and a oil pressure detected by the pressure sensor was increased, the controller sends a command signal which enables the construction machine to operate in the low-speed operation mode or the high-speed operation mode.

DESCRIPTION OF PREFERRED EMBODIMENT

Embodiments of the present invention will be explained with reference to FIGS. 1 to 6. For purposes of making it easy to explain, constituent elements similar to those of the conventional example are designated by the same reference numbers.

Figure 1:
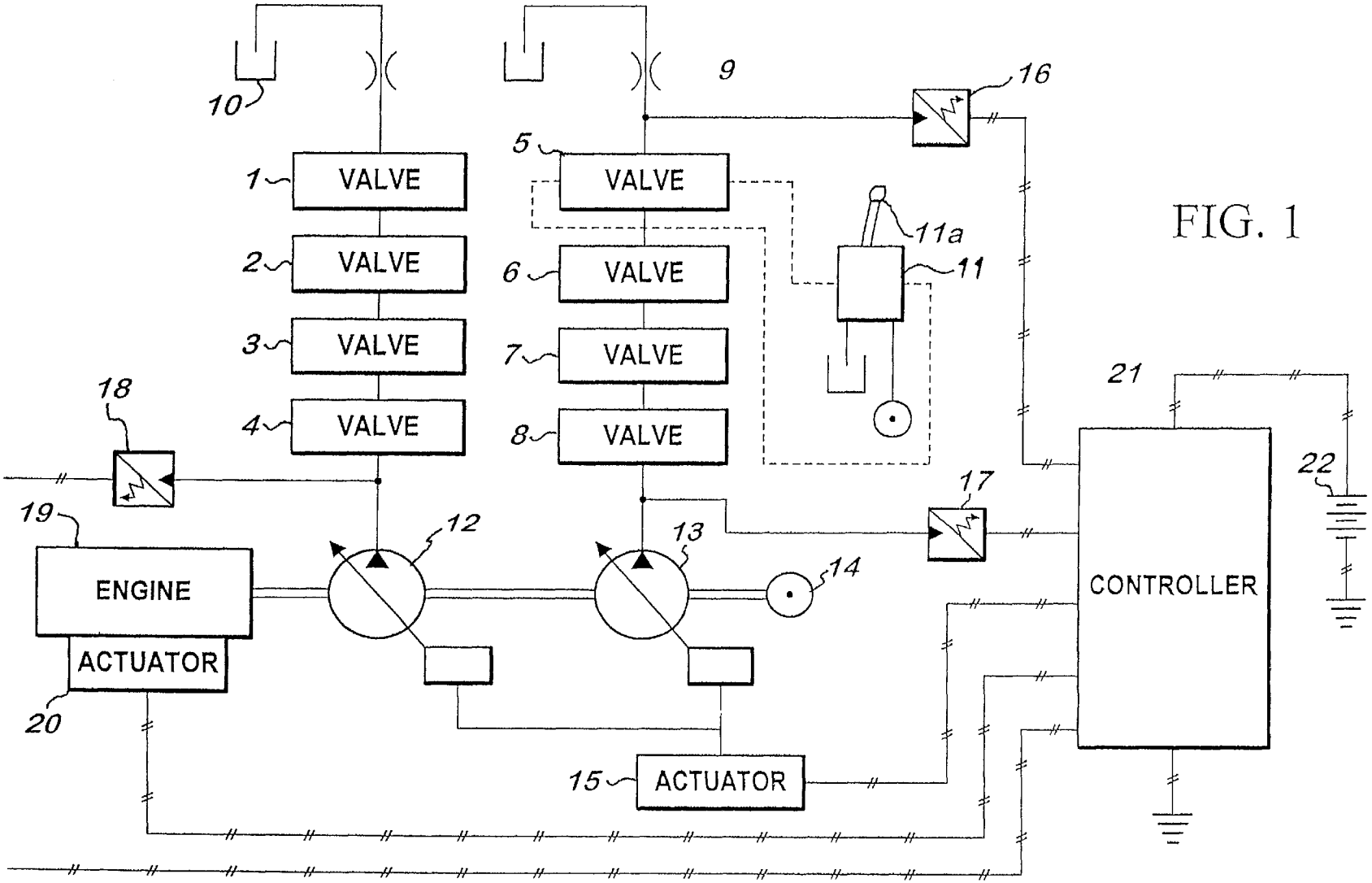
FIG. 1 is a control circuit diagram of a hydraulic shovel of an embodiment of claims 1 to 3.
Figure 2:
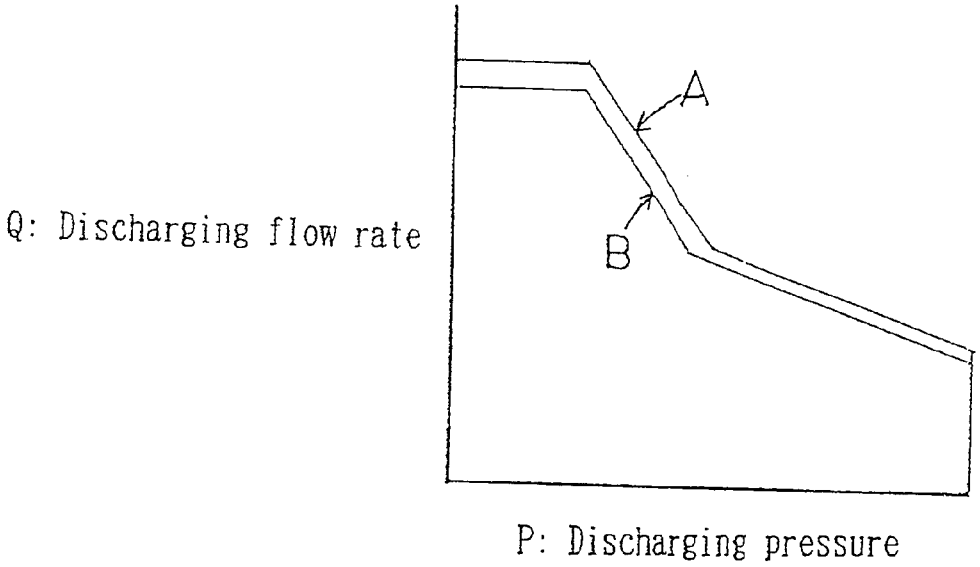
FIG. 2 is a diagram showing performance of a pump.
Figure 3:
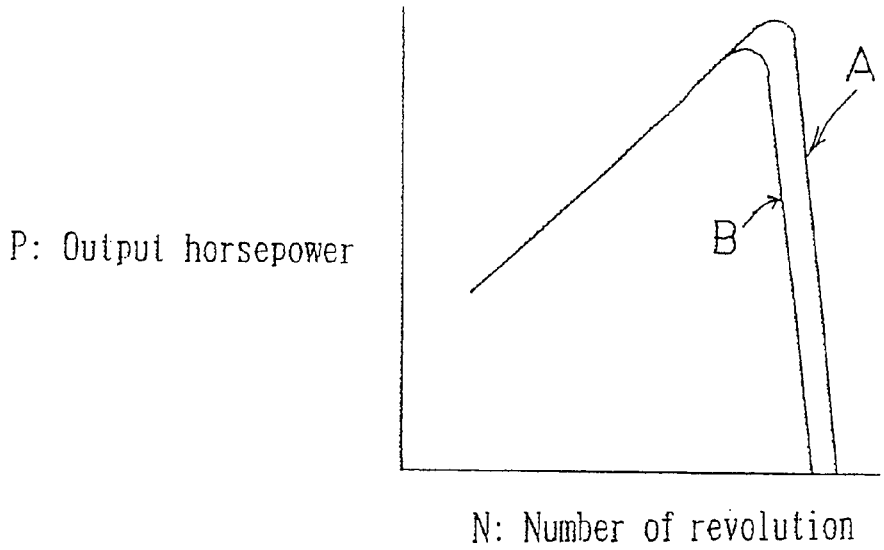
FIG. 3 is a diagram showing performance of an engine.

FIG. 1 shows one example of a control circuit diagram of a hydraulic shovel. A construction machine of the invention should not be limited to the hydraulic shovel. In the control circuit of the hydraulic shovel, a boom control valve 3 is connected to an oil path of a first hydraulic pump 12 which is driven by an engine 19, and an arm control valve 5 is connected to an oil path of a second hydraulic pump 13. Running control valves 4 and 8, as well as control valves 1 to 3, 6 and 7 for various actuators such as a bucket cylinder are connected to the first and second hydraulic pumps 12 and 13.

Figure 5:
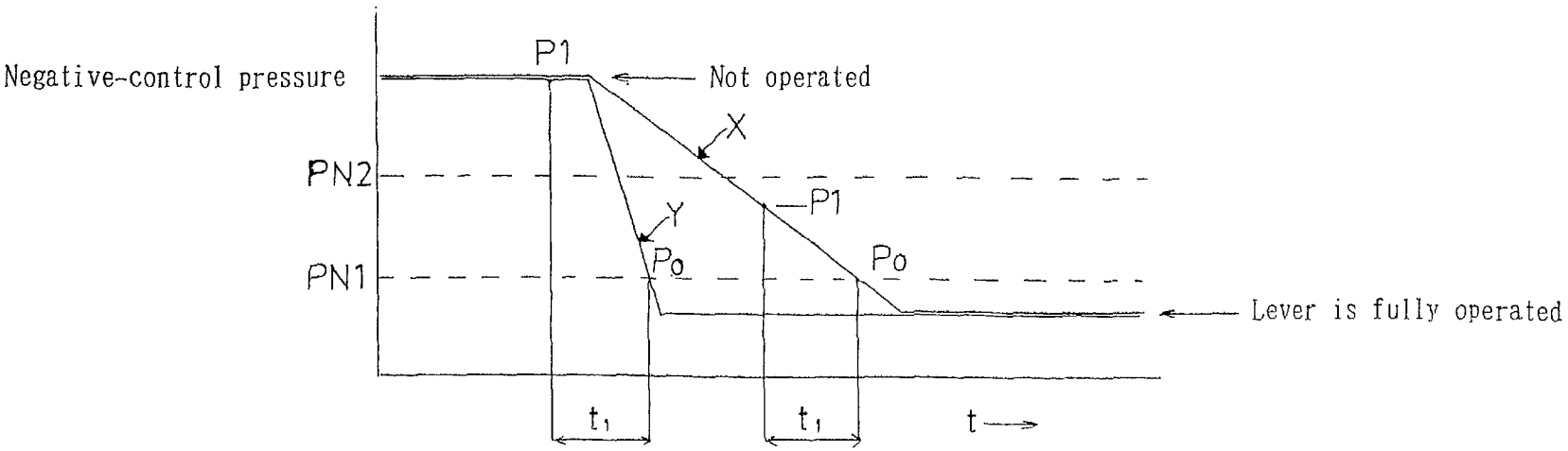
FIG. 5 is a diagram of pressure waveform of negative-control pressure.

An embodiment will be explained with reference to FIG. 1. In FIG. 1, the arm control valve 5 is connected to a lowermost portion of the oil path of the second hydraulic pump 13, and the oil path is connected to a tank 10 through a negative-control throttle valve 9. A pressure sensor 16 is provided at upstream of the negative-control throttle valve 9, and the pressure sensor 16 is connected to the controller 21, so that the pressure sensor 16 detects a hydraulic pressure of hydraulic oil of the arm control valve 5 to input a detection signal to the controller 21. The arm control valve 5 is controlled by operating an operating lever 11*a* of a remote-control valve 11. When the construction machine is operated in a low-speed operation mode and an operator desires a faster motion of the construction machine, the operator operates the operating lever 11*a* of the remote-control valve 11. This operation is detected by the pressure sensor 16 provided at upstream of the negative-control throttle valve 9. As shown in FIG. 5, when the remote-control valve 11 is operated from its non-operated state to its fully operated position, a waveform shown with a pattern X in FIG. 5 is obtained. When the remote-control valve 11 is operated quickly, a waveform shown with a pattern Y is obtained. This pressure is detected by the pressure sensor 16, and this detection signal is input to the controller 21. The controller 21 which received the detection signal performs a computation as shown FIG. 6 within a sampling time.

That is, when the hydraulic shovel is operated in the low-speed operation mode, the controller 21 monitors a hydraulic pressure of the arm control valve 5 in FIG. 5, and compares and calculates a relation between pressure when the remote-control valve 11 is not operated and arbitrary pressures PN1 and PN2 between pressure when the remote-control valve 11 is fully operated. The PN1 and PN2 are constants previously stored in the controller 21. The controller 21 is set such that it can always store a $t_1$-second-old negative-control pressure P1 of the negative-control throttle valve 9. The negative-control pressure P1 is also a constant previously stored in the controller 21.

Here, when the negative-control pressure reached pressure $P_0$ equal to or lower than PN1, $t_1$-second-old pressure P1 and PN2 are compared with each other. As a result of computation, if P1<PN2, it is judged that the operation of the operating lever 11*a* of the remote-control valve 11 is slow, the construction machine maintains the low-speed operation mode as it is, and operation in the low-speed operation mode is continued. If P1≧PN2 is attained, the controller 21 judges that faster operation of the remote-control valve 11 is required, the low-speed operation mode is switched to the high-speed operation mode by a command signal from the controller 21. This switching operation is carried out by sending a switching command signal from the controller 21 to the actuators 20 and 15 which respectively control the first and second hydraulic pumps 12 and 13 as in the conventional example.

Next, another embodiment will be explained. When the operator demands a predetermined power from the construction machine, the demanded power appears as the sum of pressures of the first and second hydraulic pumps 12 and 13. In order to detect this pressure, pressures Pm1 and Pm2 of the first and second hydraulic pumps 12 and 13 are respectively detected by pressure sensors 17 and 18 respectively provided at downstream of the first and second hydraulic pumps 12 and 13, and the detection signals are input to the controller 21. The controller 21 performs an undermentioned computation shown in FIG. 6 within a sampling time. Further, the controller 21 calculates the sum of the pressures Pm1 and Pm2 of the first and second hydraulic pumps 12 and 13. As a result of the computation, if Pm1+Pm2≧PH (PH is an arbitrary pressure for judging a high load, and this PH is a constant previously stored in the controller 21), and if this state is continued for $t_2$ seconds or longer, the controller 21 outputs a switching command signal to switch the operation mode from the low-speed operation mode to the high-speed operation mode. The reason why the controller 21 waits for $t_2$ seconds or longer is that if the load is varied abruptly and the operation modes are frequently switched, the operator will feel a sense of incongruity.

Next, another embodiment will be explained. In the case of a construction machine such as a hydraulic shovel, a boom-lowering action among various actions does not require high output of the engine 19 because a dropping power caused by a weight of the boom itself is also applied. This boom-lowering action appears as a pressure of the first hydraulic pump 12. This pressure is detected by the pressure sensor 18, and the detection signal is input to the controller 21. When the hydraulic shovel is operated in the high-speed operation mode, the controller 21 compares and calculates detection pressure Pm2 of the pressure sensor 18 and pressure PL for judging the boom-lowering action (PL is a constant previously stored in the controller 21). If Pm2≧PL, the high-speed operation mode is maintained, and the operation in the high-speed operation mode is continued. If Pm2<PL is attained, a switching command signal of the controller 21 is sent to the engine 19 as well as the actuators 20 and 15 of the first and second hydraulic pumps 12 and 13, and the operation mode is switched from the high-speed operation mode to the low-speed operation mode.

Figure 4:
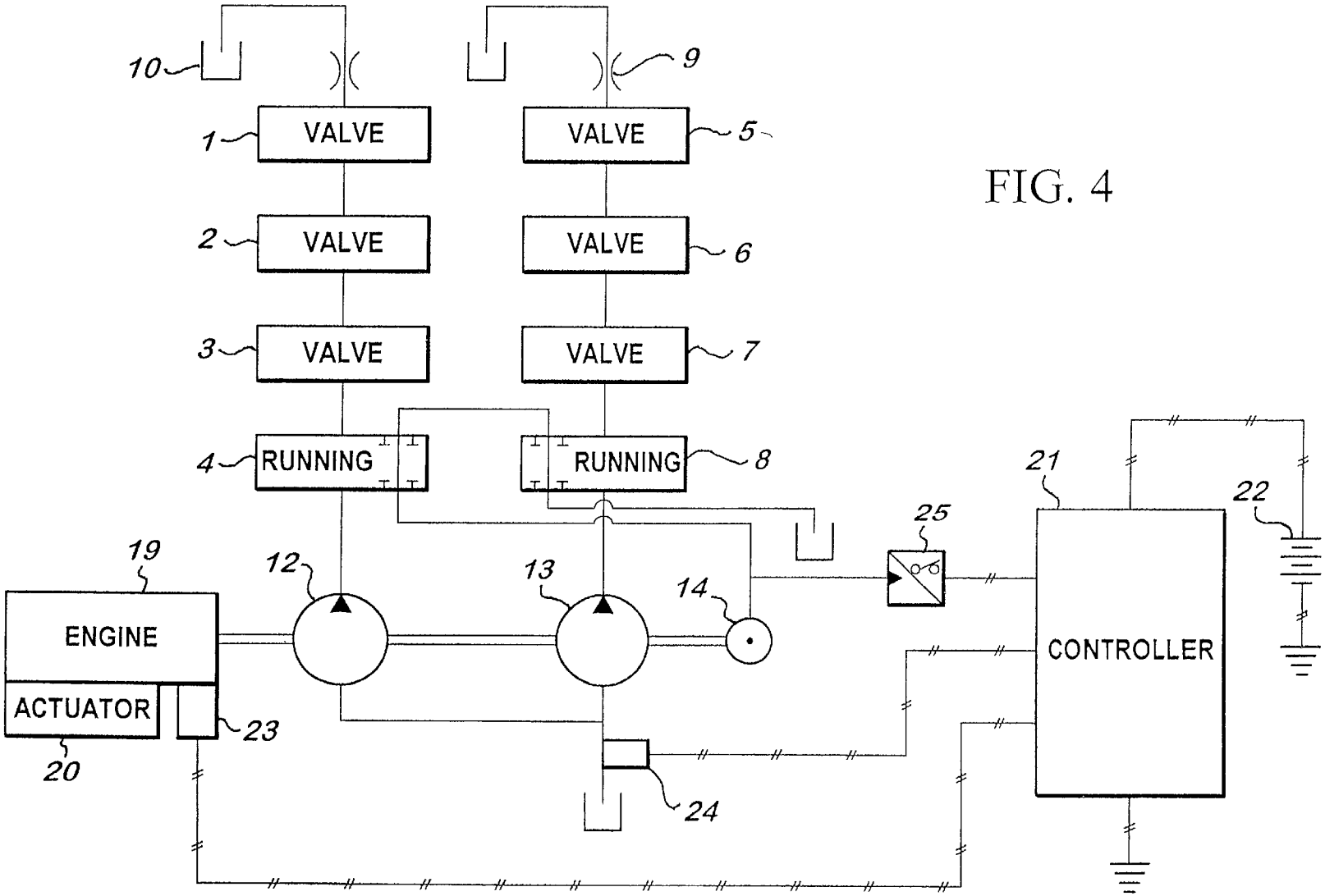
FIG. 4 is a control circuit diagram of a hydraulic shovel of another embodiment of claims 4 to 6.

Next, another embodiment will be explained. As shown in FIG. 4, in order to stably switch between the high-speed operation mode and low-speed operation mode, a radiator water-temperature sensor 23 is provided in the vicinity of the engine 19, the radiator water-temperature sensor 23 is connected to the controller 21, and the controller 21 judges whether a water temperature of the radiator reached a temperature suitable for warming-up of the engine 19. If the controller 21 judged that the water temperature of the radiator reached the temperature suitable for warming-up of the engine 19, it is possible to switch from the low-speed operation mode to the high-speed operation mode, or from the high-speed operation mode to the low-speed operation mode.

Next, another embodiment will be explained with reference to FIG. 4. In this embodiment, as in the previous embodiment, in order to stably switch from the low-speed operation mode to the high-speed operation mode, or from the high-speed operation mode to the low-speed operation mode, a hydraulic oil-temperature sensor 24 for detecting the hydraulic oil of the first and second hydraulic pumps 12 and 13 is provided in the vicinity of the tank, the hydraulic oil-temperature sensor 24 is connected to the controller 21, and the controller 21 judges whether a hydraulic oil temperature reached a temperature suitable for warming-up of a hydraulic system. If the temperature of the hydraulic oil reached the temperature suitable for the warming-up of the hydraulic system, the operation mode can be switched to the low-speed operation mode or the high-speed operation mode by a command signal from the controller 21.

Another embodiment will be explained next. In this embodiment, if the operation mode is switched during running of the construction machine, the operator may receive a shock and thus, the operation mode is not switched during running of the construction machine.

When the construction machine is running, a pilot oil path is cut off by the control valves 4 and 8, and an oil pressure in the pilot oil path is increased to turn a pressure switch 25 ON. The pressure switch 25 is connected to the controller 21, the ON signal of the pressure switch 25 is input to the controller 21. The controller 21 receives this ON signal and judges whether the mode switch should be carried out. If it is judges that the construction machine is running, the controller 21 does not output a command signal for switching the operation mode, and the operation mode is not switched. Therefore, the construction machine can run stably.

Figure 6:
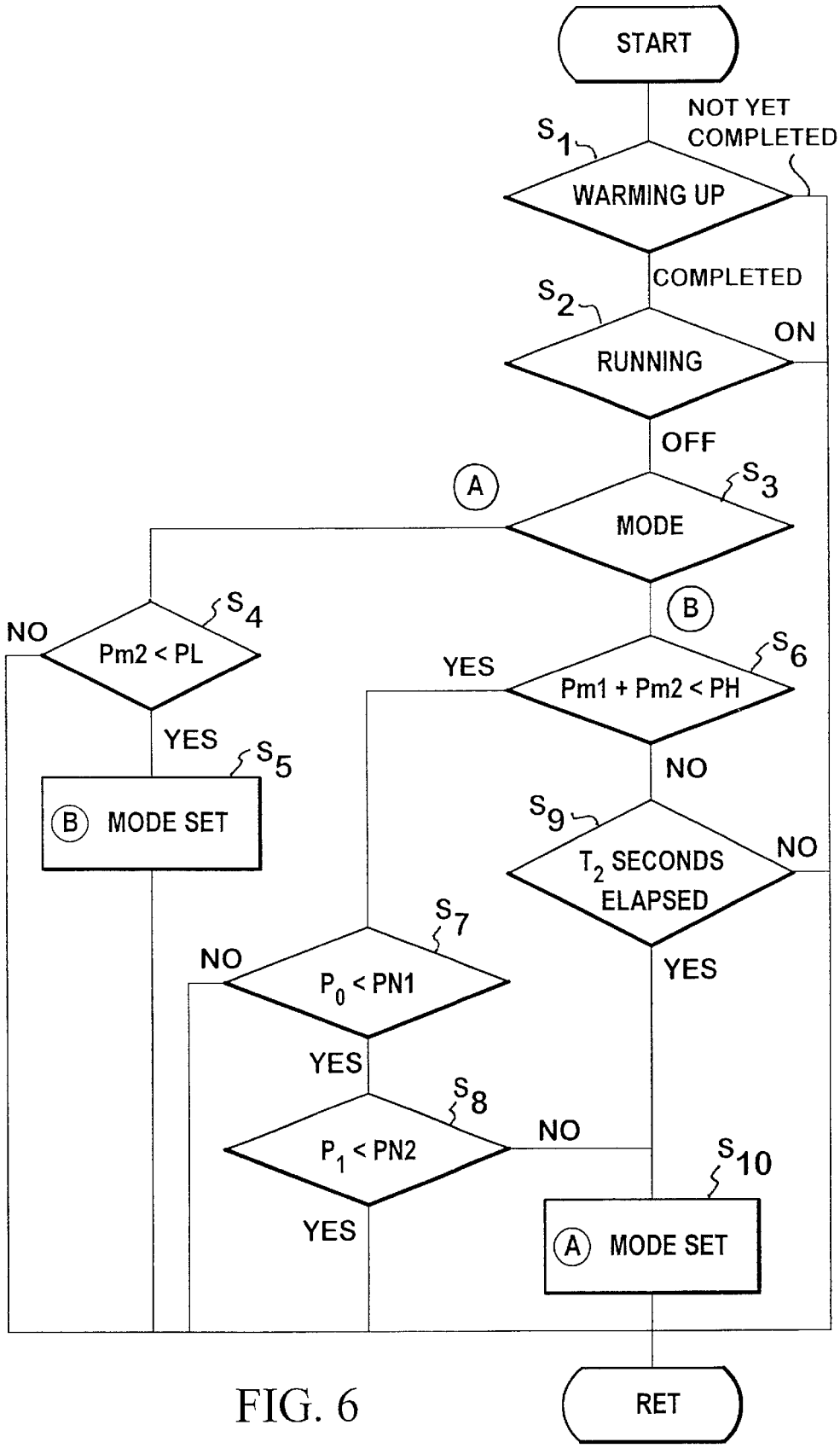
FIG. 6 is a flowchart showing operation procedure of the present invention.
Figure 7:
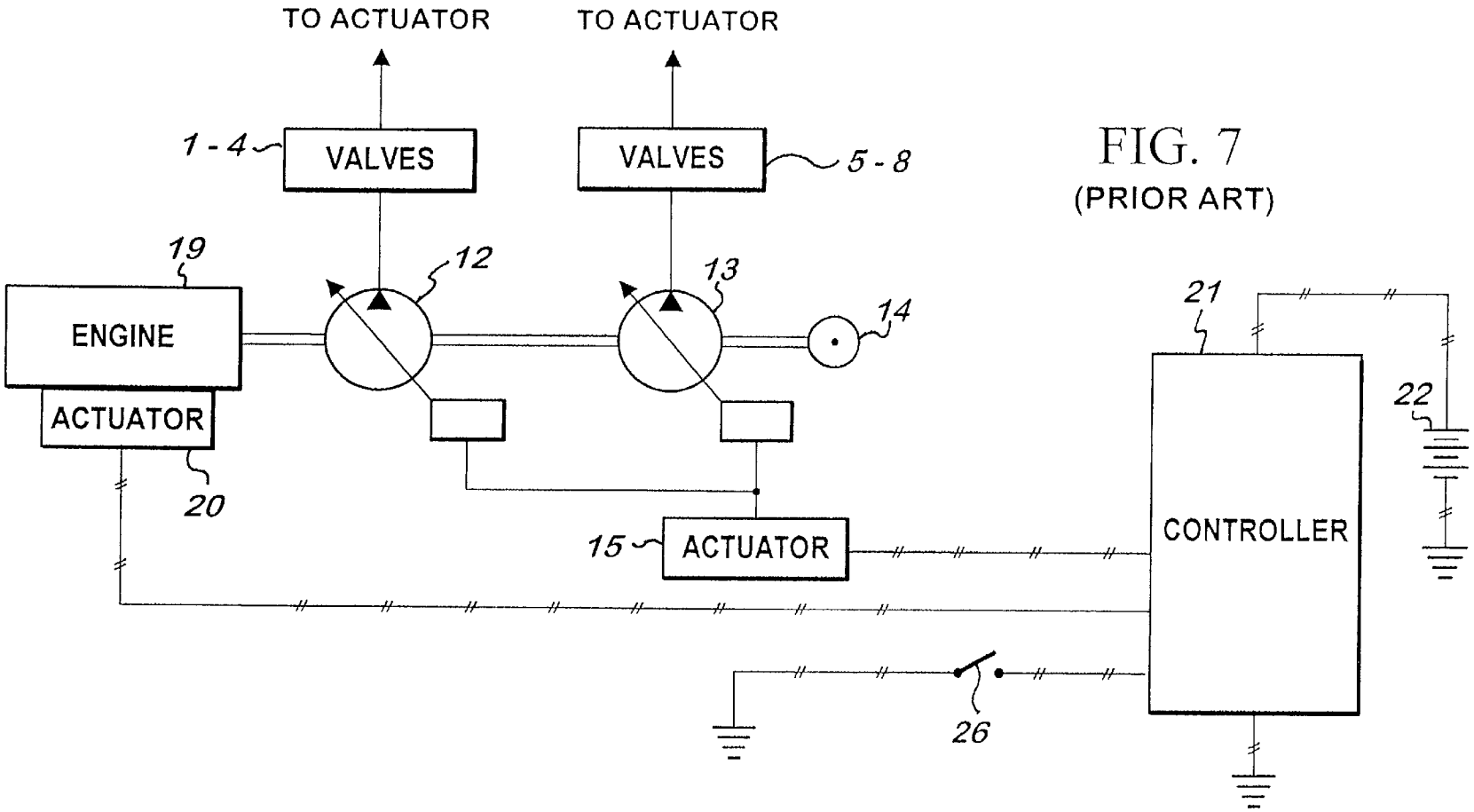
FIG. 7 (PRIOR ART)
FIG. 7 is a diagram of a control circuit of a hydraulic shovel showing a conventional switching operation between a high-speed operation mode and a low-speed operation mode.

The operation procedure of the present invention will be explained with reference to the flowchart in FIG. 6. First, the controller 21 judges whether a detection value of the radiator water-temperature sensor 23 provided in the vicinity of the engine 19 reached a water temperature suitable for warming-up of the engine 19, or whether the detection value of the hydraulic oil-temperature sensor 24 reached the warming-up temperature of the hydraulic system. If the warming-up has not yet been completed (step $S_1$), the operation mode is not switched. If the warming-up has completed, the controller 21 judges whether the construction machine is running (step $S_2$). If the construction machine is running, the operation mode is not switched. The controller 21 judges whether the construction machine stopped and the high-speed operation mode (A) was selected or the low-speed operation mode (B) was selected (step $S_3$). If the high-speed operation mode (A) was selected and the construction machine is operated in the high-speed operation mode (A), the controller 21 judges whether the pressure Pm2 of the first hydraulic pump 12 is smaller than the invariable PL (Pm2<PL) (step $S_4$). If Pm2<PL, the operation mode is automatically switched to the low-speed operation mode (B) by the command signal of the controller 21, and the construction machine is operated in the low-speed operation mode (B) (step $S_5$) If the low-speed operation mode (b) was selected and the construction machine was operated in the low-speed operation mode in step $S_3$, the pressure Pm1and Pm2 of the first and second hydraulic pumps 12 and 13 are detected by the pressure sensors 17 and 18 respectively, the controller 21 calculates the sum of the pressures, and judges whether the sum is equal to or smaller than the constant PH ($Pm1+Pm2 \leqq PH$) (step S6). If $Pm1+Pm2 \leqq PH$, the procedure is advanced to step $S_7$ where it is judged whether the negative-control pressure $P_0$ is greater than the constant PN1 previously stored in the controller 21 ($P_0<PN1$). If $P_0>PN1$, the operation in the low-speed operation mode is continued, and if $P_0<PN1$, the procedure is advanced to step $S_8$ where it is judged whether the $t_1$-second-old negative-control pressure P1 is greater than the constant PN2 previously stored in the controller 21 ($P1<PN2$). If $P1>PN2$, the operation mode is automatically switched to the high-speed operation mode and the operation is carried out in the high-speed operation mode. If $P1<PN2$, the operation in the low-speed operation mode is continued.

In step $S_6$, if $Pm1+Pm2 \geqq PH$, the procedure is advanced to step $S_9$ where the controller 21 judges whether the state of $Pm1+Pm2 \geqq PH$ is continued for $t_2$ seconds or longer. If the controller 21 judged that $Pm1+Pm2 \geqq PH$ was continued for $t_2$ seconds or longer, the procedure is advanced to step $S_{10}$ where the operation mode is automatically switched to the high-speed operation mode and the operation in the high-speed operation mode is carried out. If the above state was not continued for $t_2$ seconds or longer, the operation in the low-speed operation mode is continued.

The present invention can variously be changed without departing from the spirit, and the invention can be modified of course.

According to the present invention, as described in the embodiments, when the construction machine is operated in either one of high-speed operation mode which is excellent in both speed and power and low-speed operation mode which is suitable for low fuel consumption and fine control, the operation mode is automatically switched to one of the mode that an operator desires and the construction machine can be operated in that mode. Therefore, the present invention provides remarkable effects that troublesome switching operation is unnecessary unlike the conventional technique, the fuel consumption is reduced, the speed and power are supplemented, and operation efficiency is enhanced.

What is claimed is:

1. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein when said construction machine is operated in the low-speed operation mode and when a pressure sensor detects an operating speed of an operating lever of said remote-control valve and the detection value exceeds a predetermined value, said operation mode is automatically switched from the low-speed operation mode to the high-speed operation mode by a command signal from a controller.

2. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein when said construction machine is operated in the low-speed operation mode and when the sum of detection values detected by pressure sensors respectively provided for detecting pressures of said first and second hydraulic pumps exceed a predetermined value for a predetermined time or longer, said operation mode is automatically switched from the low-speed operation mode to the high-speed operation mode by a command signal from a controller.

3. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein when said construction machine is operated in the high-speed operation mode and when a pressure sensor detects a hydraulic pressure of the hydraulic pump associated with a lowering action and the detection value becomes equal to or lower than a predetermined value, said operation mode is automatically switched from the high-speed operation mode to the low-speed operation mode by a command signal from a controller.

4. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein a radiator water-temperature sensor for detecting a water temperature of a radiator of said engine is provided, and when a detection value of said radiator water-temperature sensor reaches a value of warming-up of said engine, said controller sends a command signal which enables said construction machine to operate in the low-speed operation mode or the high-speed operation mode.

5. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein a hydraulic oil sensor for detecting a temperature of hydraulic oil in said first and second hydraulic pumps is provided, and when a detection value of said hydraulic oil sensor reaches a value of warming-up of a hydraulic system, said controller sends a command signal which enables said construction machine to operate in the low-speed operation mode or the high-speed operation mode.

6. A control unit for a construction machine comprising a first hydraulic pump and a second hydraulic pump driven by an engine, in which control valves for various actuators are connected to oil paths of said hydraulic pumps, said control valves are operated by a remote-control valve, an operation mode of said construction machine is switchable to either one of a low-speed operation mode and a high-speed operation mode, wherein pressure sensors are provided in pilot oil paths of said first and second hydraulic pumps, and when said pilot oil paths are cut off by switching operation of a running control valve during running of said construction machine and a oil pressure detected by said pressure sensor is increased, said controller sends a command signal which enables said construction machine to operate in the low-speed operation mode or the high-speed operation mode.

* * * * *